United States Patent [19]

Bullitt et al.

[11] Patent Number: 4,654,293

[45] Date of Patent: Mar. 31, 1987

[54] DIFFUSION TRANSFER FILM UNIT WITH PH SENSITIVE FILTER BACKING LAYER

[75] Inventors: Julian G. Bullitt, Waban; F. Richard Cottrell, South Easton, both of Mass.

[73] Assignee: Polaroid Corporation, Cambridge, Mass.

[21] Appl. No.: 624,270

[22] Filed: Jun. 25, 1984

Related U.S. Application Data

[63] Continuation-in-part of Ser. No. 492,732, May 9, 1983, abandoned.

[51] Int. Cl.[4] ..... G03C 7/00; G03C 5/54

[52] U.S. Cl. ..... 430/221; 430/212

[58] Field of Search ..... 430/221, 212, 220

[56] References Cited

U.S. PATENT DOCUMENTS 3,647,437 3/1972 Land ..... 430/221

4,407,929 10/1983 Boie et al. ..... 430/212

*Primary Examiner*—Richard L. Schilling

[57] ABSTRACT

The present invention is directed to a color diffusion transfer film unit comprising a transparent support carrying on a first side at least a first photosensitive silver halide emulsion layer having dye image-providing material associated therewith, a substantially opaque layer, a reflective layer and a dye image-receiving layer; said transparent support carrying on a second side a layer initially transparent to radiation actinic to said silver halide emulsion, said initially transparent layer adapted to convert an opaque layer upon contact with alkali which prevents transmission of exposing radiation to said silver halide emulsion layer wherein said photosensitive silver halide emulsion layer is intermediate said initially transparent layer and said opaque layer.

2 Claims, 1 Drawing Figure

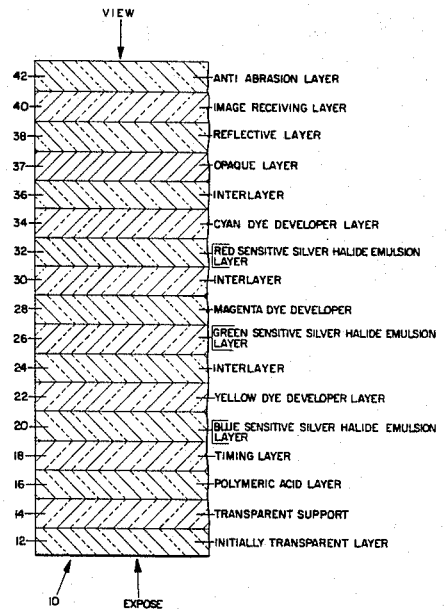

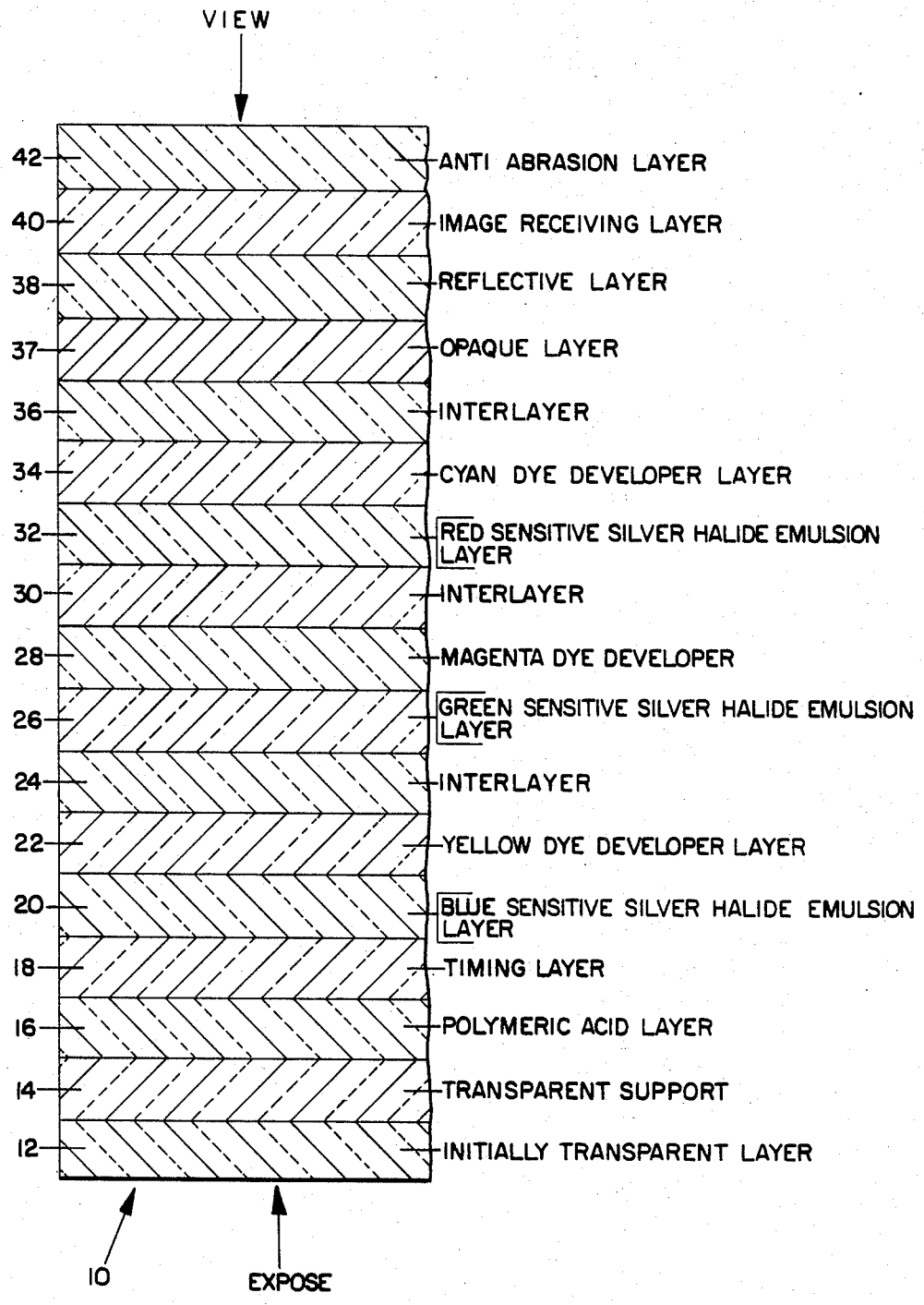
VIEW
42
ANTI ABRASION LAYER
40
IMAGE RECEIVING LAYER
38
REFLECTIVE LAYER
37
OPAQUE LAYER
36
INTERLAYER
34
CYAN DYE DEVELOPER LAYER
32
RED SENSITIVE SILVER HALIDE EMULSION LAYER
30
INTERLAYER
28
MAGENTA DYE DEVELOPER
26
GREEN SENSITIVE SILVER HALIDE EMULSION LAYER
24
INTERLAYER
22
YELLOW DYE DEVELOPER LAYER
20
BLUE SENSITIVE SILVER HALIDE EMULSION LAYER
18
TIMING LAYER
16
POLYMERIC ACID LAYER
14
TRANSPARENT SUPPORT
12
INITIALLY TRANSPARENT LAYER
10
EXPOSE

DIFFUSION TRANSFER FILM UNIT WITH PH SENSITIVE FILTER BACKING LAYER

CROSS REFERENCE TO OTHER APPLICATIONS

This application is a continuation-in-part of copending application Ser. No. 492,732, filed May 9, 1983, now abandoned.

BACKGROUND OF THE INVENTION

Color diffusion transfer film units are known to the art which are designed to be processed outside of the camera. In order to avoid fogging the exposed silver halide emulsion layer, various means have been proposed to prevent such an occurrance. For example, the photosensitive system may be sandwiched between opaque supports; or between an integral opaque-reflective layer and an opaque support. U.S. Pat. No. 3,647,437, issued Mar. 7, 1972, to Edwin H. Land, discloses, in one embodiment (FIG. 18), a film unit which comprises a transparent support carrying a layer of polymeric acid, a spacer layer, an image-receiving layer, an opaque layer, which includes a white pigment to provide a white background against which the image may be viewed, a dye developer layer, a silver halide emulsion layer, and a colorless layer containing an alkali-activated optical filter agent. The processing fluid is applied by rupturing a pod and distributing the processing fluid between a cover sheet and the colorless layer. The cover sheet may also be opaque. It is also stated that the colorless layer may also contain suitable opacifying agents such as carbon black, titanium dioxide etc., where opacifying capability additional to that provided by the colorless layer is required.

U.S. Pat. No. 4,407,929, issued Oct. 4, 1983 to Immo Boie, et al. is directed to a diffusion transfer film unit which includes a transparent support, at least one photosensitive silver halide emulsion layer having non-diffusible color providing material associated therewith, an opaque light-reflecting layer and an image-receiving layer. Boie further states that the transparent support may carry a layer which would improve flatness and improve color definition. Thus, Boie is providing a material which functions as a mask. For example, Boie proposes a material on the transparent support which will produce a white haze when contacted with the developer bath.

U.S. Pat. No. 3,647,435, issued Mar. 7, 1972 to Edwin H. Land, is referred to in Boie under the corresponding number DE-OS 2,127,924. Land discloses diffusion transfer film units which contain precursors adapted to form reflecting agents to provide a mask for the opacifying agent.

SUMMARY OF THE INVENTION

The present invention is directed to a color diffusion transfer film unit comprising a transparent support carrying on a first side, in order, at least a first photosensitive silver halide emulsion layer having dye image-providing material associated therewith, a substantially opaque layer, a reflective layer and a dye image-receiving layer, said transparent support carrying on a second side a layer initially transparent to radiation actinic to said silver halide emulsion, said initially transparent layer adapted to convert to an opaque layer upon contact with alkali which prevents transmission of exposing radiation to said silver halide emulsion layer, said photosensitive silver halide emulsion layer being located intermediate said initially transparent layer and said opaque layer.

BRIEF DESCRIPTION OF THE DRAWING

The FIGURE is a diagrammatic, enlarged cross-sectional view of a film unit of the present invention.

DETAILED DESCRIPTION OF THE INVENTION

The present invention is directed to a color diffusion transfer photographic film unit wherein all the layers are carried on a single support and the film unit is adapted to be processed outside the camera and, at least partially, in ambient room light.

In its simplest form, the film unit of the present invention comprises a transparent support carrying on a first side at least a first photosensitive silver halide emulsion layer having dye image-providing material associated therewith, a substantially opaque/reflective layer and a dye image-receiving layer. On the second side the transparent support is a layer initially transparent to radiation actinic to the photosensitive silver halide emulsion layer, i.e., which will permit transmission of sufficient radiation to expose the silver halide layer(s), but which, upon contact with alkali, converts to a condition which prevents passage or transmission of radiation actinic to the silver halide, thus preventing any further exposure of the silver halide. The photosensitive silver halide emulsion layer is intermediate the initially transparent layer and the opaque/reflective layer.

Thus, subsequent to exposure, and upon the application of processing composition, by, for example, immersion of the film unit in processing composition, upon sufficient up-take of processing composition the film unit may be taken into room light where the formation of the image in the image-receiving layer can be observed without any further exposure of the silver halide occurring. Conversion of the initially transparent layer to a non-transmissive condition is effected upon contact with the aqueous alkaline processing composition. While one side of the silver halide emulsion layer is protected from further exposure by the initially transparent layer which is converted to a barrier of exposing radiation, the other side is protected by the opaque layer in the film unit, through which the image-forming material diffuses and which provides the background for the image.

A variety of materials known to the art may be employed to provide the layer adapted to convert from a substantially transparent condition to a substantially opaque condition upon contact with alkali.

In one embodiment, alkali-activated optical filter agents or indicator dyes may be employed, provided they provide sufficient opacity to prevent further exposure of the silver halide emulsions.

In a preferred embodiment, the quaternary nitrogen-containing polymeric materials disclosed and claimed in copending application of Louis Locatell, Jr. and Charles M. Zepp, Ser. No. 492,696 filed May 9, 1983, now U.S. Pat. No. 4,452,878, issued June 5, 1984, and commonly assigned, is employed as the layer adapted to convert from a substantially transparent condition to a substantially opaque condition.

In a particularly preferred embodiment, the black polymer is employed, as disclosed and claimed in U.S. Pat. No. 4,452,878.

Referring now to the drawing, a preferred film unit within the scope of the present invention is illustrated.

Film unit 10 comprises a transparent support 14, through which exposure of the photosensitive layers takes place, which carries on one side layer 12, which is initially transparent to radiation actinic to said silver halide emulsion and which, upon contact with alkali; e.g. an indicator dye converts to an opaque layer which prevents transmission of exposing radiation to the silver halide emulsion layer. On the opposite side, support 14 carries polymeric acid layer 16, timing layer 18, blue-sensitive silver halide emulsion layer 20, yellow dye developer layer 22, interlayer 24, green-sensitive silver halide emulsion layer 26, magenta dye developer layer 28, interlayer 30, red sensitive silver halide emulsion layer 32, cyan dye developer layer 34, interlayer 36, opaque layer 37, reflective layer 38, which preferably contains a white pigment, such as titanium dioxide to provide a white background against which the image is received, and an additional opacifying material such as carbon black, image-receiving layer 40 and anti-abrasion layer 42. It will be noted that the image is viewed from the opposite side the film unit is exposed, i.e. through the antiabrasion layer.

A variety of dye image-forming materials may be employed in the present invention. For a detailed discussion of such materials, see, for example, Research Disclosure 15162, November, 1976. A particularly preferred class of dye image-forming materials comprise the dye developers (dyes which are also silver halide developing agents). See, for example, U.S. Pat. No. 3,983,606.

The indicated Research Disclosure publication may also be referred to for disclosure relevant to diffusion transfer processes, suitable silver halide emulsion layers, developing agents, image-receiving layers, opaque/reflective layers, interlayers, and the like.

What is claimed is:

1. A color diffusion transfer film unit comprising a transparent support carrying on a first side, in order, at least a first photosensitive silver halide emulsion layer having dye developer associated therewith, a substantially opaque layer, a reflective layer and a dye image-receiving layer; said transparent support carrying on a second side a layer initially transparent to radiation actinic to said silver halide emulsion, said initially transparent layer adapted to convert to an opaque layer upon contact with alkali which prevents transmission of exposing radiation to said silver halide emulsion layer wherein said photosensitive silver halide emulsion layer is intermediate said initially transparent layer and said opaque layer.

2. The film unit of claim 1 which includes a red-sensitive silver halide unit having associated therewith a cyan dye developer;

a green-sensitive silver halide unit having associated therewith a magenta dye developer; and a blue-sensitive silver halide unit having associated therewith a yellow dye developer.

* * * * *